United States Patent [19]

Highley et al.

[11] Patent Number: 4,574,035

[45] Date of Patent: Mar. 4, 1986

[54] WARP-RESISTANT SELF-SEALING COKE OVEN DOOR

[76] Inventors: Robert W. Highley, 1802 W. 159th Ave., Crown Point, Ind. 46307; Stephen J. Stanczak, 9135 S. Western Ave., Chicago, Ill. 60620

[21] Appl. No.: 671,627

[22] Filed: Nov. 15, 1984

[51] Int. Cl.[4] ..... C10B 25/02; C10B 25/06; C10B 25/16

[52] U.S. Cl. ..... 202/242; 202/269

[58] Field of Search ..... 202/242, 248, 269, 270; 110/173 R

[56] References Cited

U.S. PATENT DOCUMENTS

| | | | |
|---|---|---|---|
| 2,126,239 | 8/1938 | Beimann | 202/248 |
| 2,183,704 | 12/1939 | Wilputte | 202/248 |
| 2,195,840 | 4/1940 | Potter | 202/248 |
| 2,338,675 | 1/1944 | Van Ackeren | 202/248 |
| 2,993,845 | 7/1961 | Coe | 202/240 |
| 4,118,284 | 10/1978 | Bowman et al. | 110/173 R |
| 4,119,496 | 10/1978 | Campana | 202/248 |
| 4,230,532 | 10/1978 | Harris | 202/248 |

FOREIGN PATENT DOCUMENTS

| | | | |
|---|---|---|---|
| 867239 | 2/1953 | Fed. Rep. of Germany | 202/248 |

OTHER PUBLICATIONS

"The Making, Shaping and Treating of Steel", by Harold E. McGannon, Ninth Ed., Published by U.S. Steel Corporation, pp. 121,122.

*Primary Examiner*—Peter Kratz

*Attorney, Agent, or Firm*—Marshall, O'Toole, Gerstein, Murray & Bicknell

[57] ABSTRACT

A fabricated self-sealing coke oven door which is resistant to warping formed of a rigid steel plate which overlies the mouth of a coking chamber of a coke oven having longitudinal and transverse rectangular stiffener plates welded to the door plate at points spaced inwardly from the edges of the door plate with a plurality of transverse braces weldably interconnecting the longitudinal stiffener plates at spaced points intermediate the ends thereof and welded to the door plates, a plurality of additional transverse braces having one end welded to a longitudinal stiffener plate and the other end welded to the door plate, a rectangular bar welded to the upper edge of each of the stiffener plates extending the length thereof and outwardly to the edge of the door plate in a plane parallel to the plane of the door plate, and a plurality of spring box means at spaced points along the length of each rectangular bar comprising a length of tubing disposed between the rectangular bar and the door plate adapted to co-act through apertures in the door plate with a sealing ring adapted to be mounted on the inner surface of the door plate. At least two of the transverse braces are adapted to support with the door plate a heat resistant plug for the mouth of the coking chamber on the inner surface of the door plate, and two of the transverse braces can be solid rectangular blocks which support door latches which maintain the oven door in operative position at the mouth of the coking chamber.

11 Claims, 7 Drawing Figures

FIG. 3
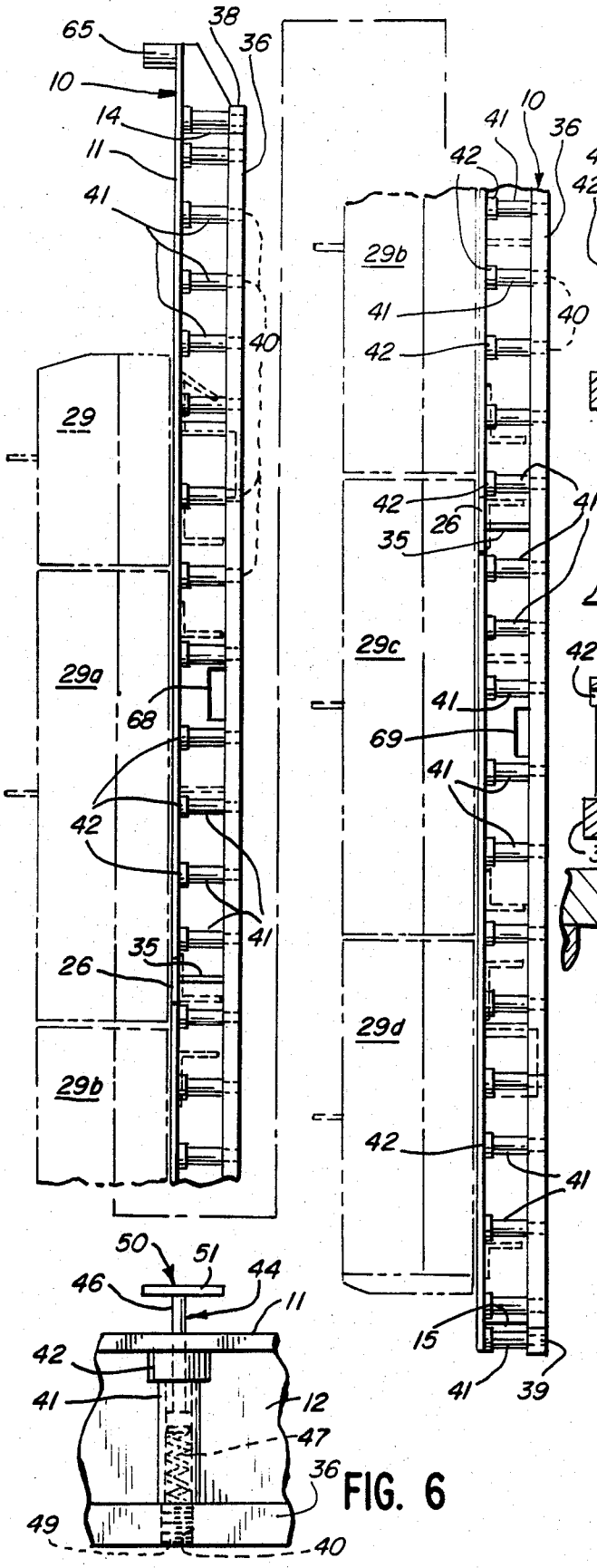
FIG. 4
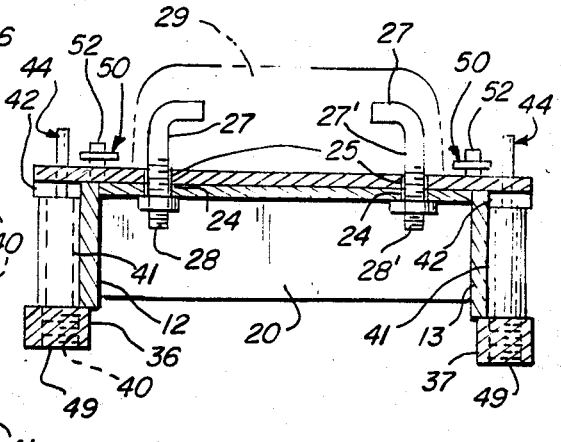
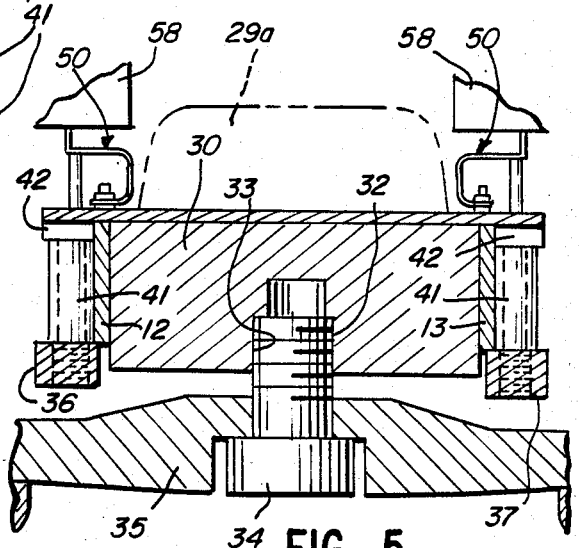
FIG. 5
FIG. 6
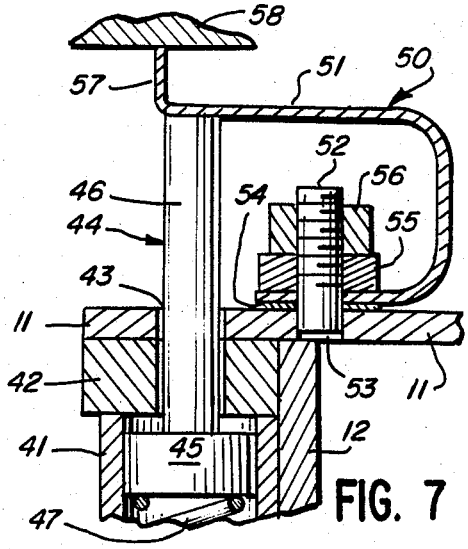
FIG. 7

WARP-RESISTANT SELF-SEALING COKE OVEN DOOR

The invention relates generally to a self-sealing oven door and more particulary to a self-sealing door which is highly resistant to warping for a coking chamber of a by-product coke oven.

Coke for metallurgical use and blast furnaces is produced by heating coal in a coke oven having a non-oxidizing atmosphere to remove by distillation the volatile matter contained in the coal. The coke ovens in common commercial use are formed of a battery of horizontally elongated narrow coking chambers open at both ends but provided with heat-resistant lined doors at each end for sealing the coking chamber during the coking operation. The doors which are removably mounted at each end of the coking chamber have very similar structures with the front end or pusher side being slightly smaller than the rear end or coke side. The door at the pusher side is also provided with an opening or leveler door adjacent the upper end to permit insertion of a bar for leveling the coal charged into the chamber and removal of any excess coal. Each door is preferably provided with self-sealing means to prevent air entering and/or gasses escaping via the door during the coking operation.

The coke oven doors which have self-sealing means generally comprise flexible means mounted on the oven door for making a metal-to-metal contact between the door and the oven to prevent gas leakage from the coke oven. The coke oven doors currently in use, however, frequently fail to maintain a sealing engagement with the coke oven after a relatively short period of use, primarily because of warping of the oven door which causes the self-sealing means to fail. Cast iron coke oven doors are particularly susceptible to warping and when this occurs it is necessary to repair the entire door at considerable cost. Coke oven door expenses are a large factor in the overall repair and maintenance expenses of present-day coke ovens.

It is important to prevent the escape of coke oven gasses from the coking chambers via the oven door during a coking operation, because the hot coke oven gasses are highly combustible and cause serious oxidation damage to the oven door and the insulation material mounted on the door. Generally, it is necessary to repair the entire door and insulation when there is gas leakage through the coke oven door.

A further important reason for preventing gasses escaping through a coke oven door is the harmful nature of the gasses such that the U.S. Environmental Protection Agency is presently preparing regulations limiting the amount of gasses which are emitted from a coke oven. Where the gas emissions are greater than the specified amounts, it will be necessary either to close down the coke ovens or at great expense place the ovens within an enclosure and treat the gasses before they are discharged into the atmosphere.

It is, therefore, an object of the present invention to overcome the objectionable features of the prior art coke oven doors by providing a fabricated self-sealing coke oven door which is highly resistant to warping and which effectively prevents gasses escaping from a coke oven over long period of use.

It is also an object of the present invention to provide a fabricated self-sealing coke oven door which is relatively light and is less expensive to produce than present coke oven doors.

It is still another object of the invention to provide at a reduced cost of production a self-sealing coke oven door which is fabricated from steel plate and tubing and weldably interconnected so as to better resist the stresses to which a coke oven door is subjected during a coking process.

Other objects of the present invention will be apparent to those skilled in the art from the following detailed description and claims when read in conjunction with the accompanying drawing wherein:

FIG. 3 is an exploded side elevational view of the oven door of FIG. 1;

FIG. 4 is a fragmentary vertical sectional view taken along the line 4—4 of FIG. 2 showing reinforcing frame-work of the door of FIGS. 1-3 and a heat-resistant plug mounted thereon;

FIG. 5 is a fragmentary vertical sectional view taken along the line 5—5 of FIG. 2 and showing a door latch means and self-sealing means for the door of FIG. 1 in assembled operative position;

Figure 1:
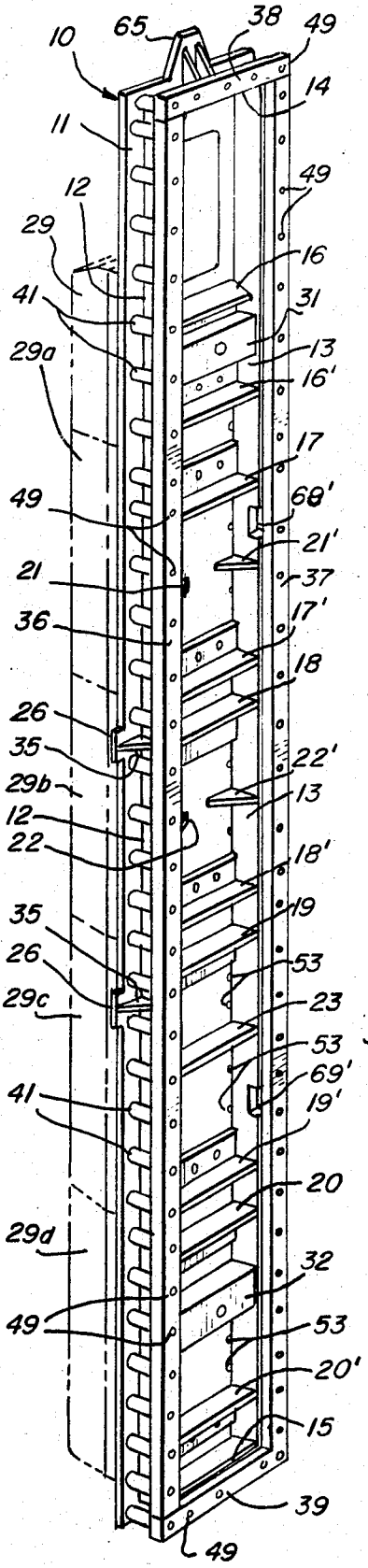
FIG. 1 is a perspective view of a partially assembled coke oven door embodying the present invention.
Figure 2:
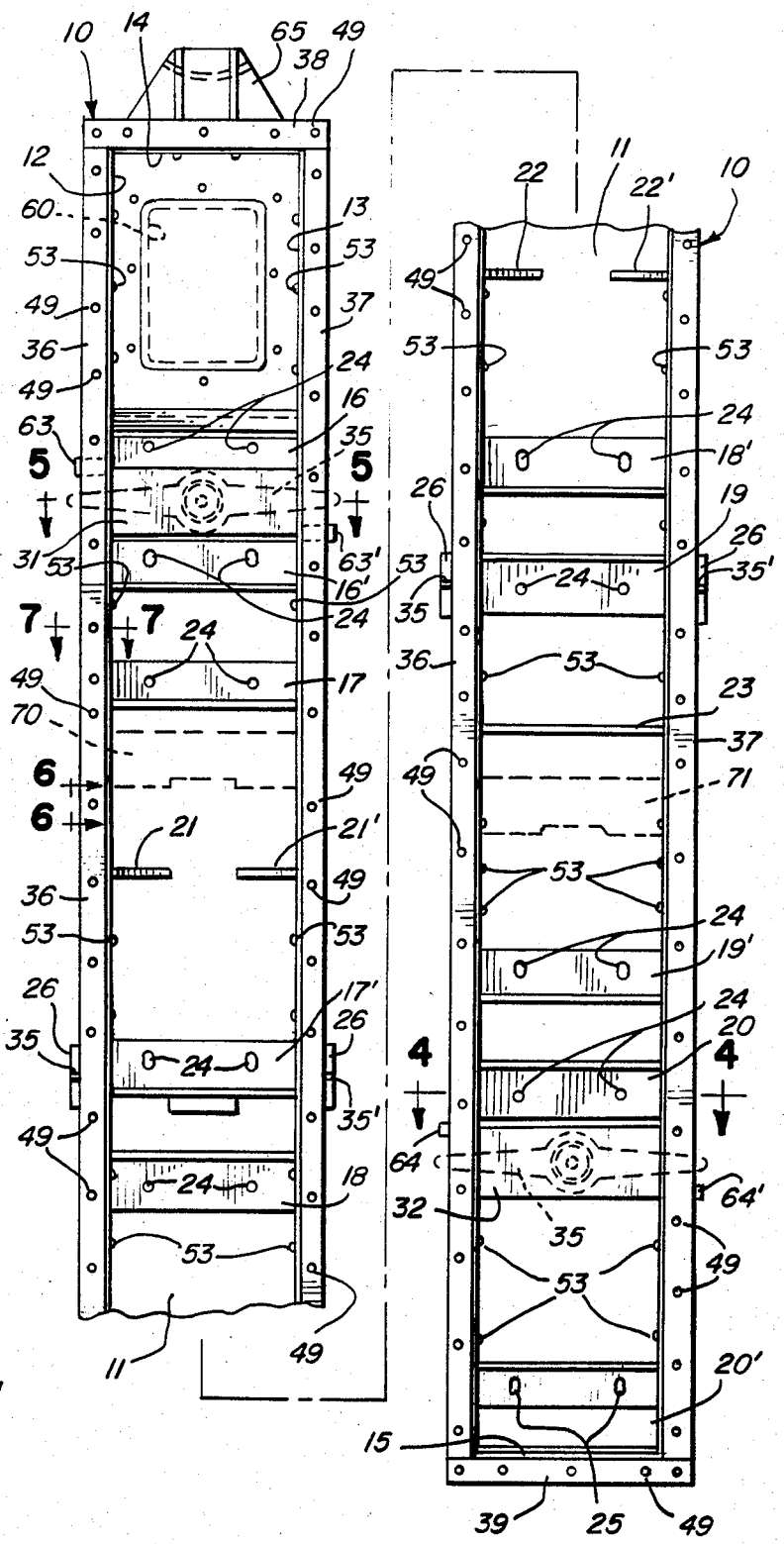
FIG. 2 is a top plan view of the oven door of FIG. 1.

FIG. 6 is a fragmentary side elevational view partially in vertical section taken along the line 6—6 of FIG. 2 showing a spring box assembly as used on the door of FIGS. 1-3; and FIG. 7 is a fragmentary vertical sectional view partially in elevation taken along the line 7—7 of FIG. 2 showing the details of a spring box assembly of FIG. 6 and a sealing ring as mounted on the door of FIG. 1 in operative position.

A preferred embodiment of the applicant's fabricated coke oven door having improved warp-resistant properties can be produced by constructing on a generally rectangular steel door plate, which has slightly larger dimensions than the mouth of the coke oven, a reinforcing structure or frame-work comprising spaced longitudinal and transverse steel rectangular stiffener plates extending longitudinally substantially the length of the door plate but spaced inwardly from each of the longitudinal and transverse edges of the door plate with the wider sides of the plates disposed perpendicular to the outer surface of the door plate. A plurality of transverse steel angle bars and braces interconnect the longitudinally extending steel plates at spaced points along their length so that a reinforcing structure is formed which resists stresses due to temperature differences at various locations within the coking chamber during the coking process.

A self-sealing means for the coke oven door is incorporated into the reinforcing structure in an efficient and economical manner so as to form a unitary reinforcing framework by securely connecting to the outer end of each of the longitudinal and transverse steel stiffener plates a steel rectangular bar having the same length as the stiffener plate with which it is associated and having the steel bars extending laterally outwardly in a plane parallel to the plane of the door plate to at least the outer edge of the door plate. A tubular means is disposed in axial alignment with each of a plurality of closely spaced apertures formed in the steel bars and the tubular means are adapted to form spring boxes which coact with sealing means, such as a conventional U-shaped resilient sealing ring, mounted on the inner surface of a coke oven door plate to form a sealing engagement along the entire periphery of a coke oven chamber when the oven door is mounted in operative position on the coke oven.

The structural details of the foregoing preferred embodiment of a pusher side coke oven door are shown in FIGS. 1–7 of the accompanying drawing wherein a generally rectangular rigid steel door plate 11 typically being about 22 feet long, 25 inches wide, and 0.5 inches thick having dimensions so as to overlie the pusher-side opening of a coking chamber which is about 20 feet high and 19 inches wide is provided with a reinforcing warp-resistant structure comprising spaced longitudinally extending members in the form of straight rigid rectangular steel stiffener plates 12,13 approximately 21 feet long, 5.5 inches wide, and 0.5 inches thick, each welded to the outer surface of the door plate 11 at points spaced inwardly from the longitudinal edges of the door plate 11, preferably about 2 inches, with their wide surfaces extending perpendicular of the door plate 11. The upper and lower ends of the stiffener plates 12,13 are weldably connected by upper and lower transverse stiffener plates 14,15 respectively. The transverse stiffener plates 14,15 typically are 20.5 inches long, 5.5 inches wide and 0.5 inches thick and are also welded to the door plate 11 and lie in a plane perpendicular to the plane of the door plate 11.

The longitudinally extending stiffener plates 12,13 and door plate 11 are interconnected to form a reinforcing steel framework at spaced points along their lengths by transverse angle bars 16,16', 17,17', 18,18', 19,19', and 20,20', short transverse braces 21,21', 22,22' and a cross brace 23 which is 20.5 inches long, 5.5 inches wide and 0.5 inches thick. The angle bars are typically 20.5 inches long, 0.375 inches thick and have perpendicular arms 5.0 inches in length. The transverse braces typically are 7.1 inches long, 3.0 inches high and 0.5 inches thick. Each of the transverse angle bars and the cross bar 23 are weldably secured to the door plate 11 and have their ends welded to the stiffener plates 12,13. The transverse braces 21,21' and 22,22' have their outer ends and lower surfaces weldably connected to the contiguous stiffener plates 12,13 and to the door plate 11, respectively.

The longitudinally extending legs of each of the angle bars and the door plate 11 are provided with apertures 24,25, respectively, which are adapted to receive the threaded shank 28,28' of the mounting bolts 27,27', respectively, extending rearwardly from a stainless steel plug or one of the heat-resistant refractory blocks 29, **29*a*, 29*b*, 29*c* 29*d* which are mounted on the inner surface of the door plate 11. Each refractory block of the type illustrated in the drawing has two hook-type mounting bolts 27,27' extending rearwardly therefrom adjacent its upper and lower ends (see FIG. 4), and the said angle bars 16–20' are arranged in pairs to accommodate the bolts 27,27'. The apertures in the lower of each pair of angle bars 16–20' are elongated to allow for expansion. The longitudinal legs of the angle bars 16–20' together with the door plate 11 provide a double thickness of steel at points of great stress in the door plate 11 due to the weight of the very heavy refractory blocks or stainless steel plug. The assembly of refractory blocks 29–29*d* when mounted in the above manner on the inner surface of the door plate 11** provides a heat-resistant door lining and extends into the furnace forming a stopper or plug in the opening of the coking chamber.

The reinforcing framework on the outer surface of the door plate 11 includes upper and lower oven door latch support blocks 31,32, respectively, extending transversely between the stiffener plates 12,13 with their ends welded to the contiguous stiffener plates 12,13 and their lower edges welded to the door plate 11. Each steel mounted block 31,32 is about 6.5 inches wide, 6.5 inches thick, and 20.5 inches long, and has at the midpoint of the upper surface a bore 33 threaded to receive a latch screw 34 which retains rotably therein a door latch bar 35 having camming surfaces adapted to engage a latch retainer mounted on the door frame of the coking chamber.

The warp-resistant reinforcing structure on the door plate 11 incorporates integrally therewith oven door self-sealing means comprising longitudinally and transversely extending steel rectangular bars 36, 37, 38 and 39 each about 2 inches thick and 2.25 inches wide, each having the same length as the stiffener strips 12–15, respectively, and weldably secured to the upper end of each of the stiffener strips 12, 13, 14 and 15, respectively. Each of the rectangular bars extends laterally outwardly in a plane parallel with the plane of the door plate 11 to at least the outer edge of the door plate 11. The longitudinally extending bars 36,37 are preferably provided with at least two longitudinally spaced steel outer braces 35,35' and laterally extending door stop plates 26,26'. Each of the outer braces 35,35' is welded to a contiguous rectangular bar and stiffener plate and to the door plate 11. Each outer brace is about 2.62 inches wide, 5.5 inches high and 0.5 inches thick.

Each of the rectangular bars 36–39 has threaded passages 40 therein at closely spaced intervals along their length which are adapted to receive an adjusting screw 49. A section of steel tubing 41 having a length of about 4.5 inches, an outer diameter of about 1.75 inches and a wall thickness of about 0.25 inches is preferably weldably secured between the inner surface of the rectangular bars 36–39 and the outer surface of the door plate 11 in axial alignment with each of the threaded passages 40 in the rectangular bars 36–39. The lower end of each tubing section 41 is preferably supported by a guide plate 42 and is weldably secured thereto. Each guide plate 42 is about 1.0 inch thick, 2 inches wide and 2.5 inches long and is provided with a bore of smaller diameter than the inner diameter of the tubing sections with the bore disposed in axial alignment with one of the threaded passages 40. Each tubing section 41 and guide plate 42 are weldably connected to a contiguous rectangular bar 36–39 and door plate 11, respectively. The door plate 11 has an aperture 43 extending therethrough of the same diameter as the bore of the guide ring 42 and in axial alignment therewith (See FIG. 7).

As best shown in FIGS. 6 and 7, each of the tubing sections 41 is adapted to retain reciprocably therein a plunger member 44 having an enlarged outer head 45 with a diameter slightly smaller than the inner diameter of the tubing section 41. The shank portion 46 of the plunger 44 is adapted to move reciprocably in the bore of the guide ring 42 and the matching aperture 43 in the door plate 11. A spring means 47 is seated within each tubing section 41 and is retained between the enlarged head portion 45 of the plunger 44 and the adjusting screw 49 seated in each of the threaded passages 40 of the rectangular bars 36–39. The spring means 47 is adapted to urge the shank portion 46 of the plunger 44 into engagement with a resilient sealing means 50 mounted on the inner surface of the door plate 11.

The sealing means 50 comprises a continuous flexible U-shaped metal ring 51 which is supported by a plurality of studs 52 mounted in apertures 53 formed in the door plate 11 at intervals spaced inwardly of the periphery of the door plate 11. The sealing ring 51 has perforations coinciding with the spacing of the studs 52 and is retained thereon over a fiber gasket strip 54 by a steel retaining strip or bar 55 having matching spaced perforations and with a retaining nut 56 threadably mounted on the end of each of the studs 52 holding the sealing ring 51 in place. The inner end of the sealing ring 51 has a forwardly extending flange 57 which, when urged forwardly by the spring biased plunger 44, is adapted to sealably engage the door frame 58 of the coking chamber.

The door plate 11 of the pusher-side door has a passage 60 formed adjacent the upper end thereof which is sealably closed by a retractable door 61 through which a leveler bar (not shown) can be inserted into the interior of the coking chamber to level off the coal charged into the chamber through the upper wall thereof. The leveler door 61, best shown in FIG. 2 of the drawing, is about 1.5 feet high, 1.0 feet wide, and is centered in plate 11 about 1.25 feet from the upper end of the door plate 11.

The door plate 11 is also provided with spaced laterally extending door stops 63, 64 and 63', 64' to facilitate mounting the oven door 10 on the frame 58 of the coking chamber. An oven door support hook 65 is also weldably secured to the upper end of the door plate 11 for supporting the oven door in the opening of the coking chamber. The longitudinal stiffener plates 12,13 are provided with longitudinally spaced openings 68, 69 and 68',69' to accommodate door lift means. Transverse hook plates 70,71 are mounted between plates 12,13 to facilitate further the positioning of the door 10 in the opening of the coking chamber.

A coke-side door for closing the end of the coking chamber opposite the pusher side opening is constructed in the same manner as described for the pusher-side door 10 except that no passage or leveler door are provided adjacent the upper end thereof.

The coke oven door of the present invention is preferably constructed of 0.5 inch thick ASTM A36 steel having a yield strength of 36 KSI, a tensile strength of 80 kg1, and a percent elongation in 2 inches of 23 and will resist warping and maintain a sealable engagement between the coke oven door and the frame around the opening of the coking chamber for long periods of use. Other weldable structural quality carbon steels having a strength greater or less than the A36 steel can be used to construct the coke oven door structure of the present invention, but the thickness of the plate material must be adjusted accordingly. It will also be understood that the dimensions specified for the several parts of the door structure disclosed herein should be adjusted upwardly or downwardly when the dimensions of the coking chamber opening are significantly larger or smaller than the chamber on which the oven door 10 is adapted to sealably close. A typical pusher-side coke oven door embodying the herein disclosed structure without the replaceable elements, such as the refractory plug and the sealing ring, or parts which are not integrally formed therewith, such as the hold down bars, will weigh about 3123 pounds, and the coke-side door will weigh about 3340 pounds when both are formed of 0.5 inch A36 steel plate.

It should be further understood that the reinforced steel coke oven door of the present invention will generally be made and sold without parts which are not an integral part of the reinforcing structure, such as hold down or latch bars, and without parts which require replacement during use, including sealing ring, sealing hold down strip, sealing ring gasket, heat resistant blocks which form the plug, spring box plungers, and springs.

We claim:

1. A fabricated coke oven door having a reinforcing warp-resistant construction for maintaining a long-lasting sealing engagement with a generally rectangular opening of a coking chamber comprising: a rigid door plate dimensioned to overlie the opening of a coking chamber, elongated rectangular spaced longitudinal stiffener plates extending substantially the length of said door plate and secured to the outer side of the door plate, rectangular transverse stiffener plates secured to the ends of said longitudinal stiffener plates, said stiffener plates spaced from the longitudinal and transverse edges of the door plate and having the wide sides thereof disposed perpendicular to the outer surface of the door plate, a plurality of transverse braces connecting said longitudinally extending stiffener plates at spaced intervals along the length of the longitudinal stiffener plates and said transverse braces being secured to said door plate, each said stiffener plate having secured to the outer end thereof a rectangular bar of like length with each of said rectangular bars extending laterally outwardly to about the edge of said door plate in a plane parallel with the plane of the door plate, spring box means fixedly disposed between the lower surface of said rectangular bars and said door plate forming a reinforcing rigid framework with said door plate, and said spring box means adapted to co-act through apertures in said door plate with sealing means which is mountable on the inner surface of said door plate to form a sealing engagement between said oven door and a door frame of said coking chamber when said oven door is operatively mounted on said coking chamber.

2. A coke oven door as in claim 1, wherein said rectangular bars have passages therethrough at spaced intervals along the length thereof, said spring box means comprising a tubular section extending inwardly from said rectangular bar disposed in axial alignment with said passages therein and secured to said rectangular bar, each said tubular section adapted to retain therein a reciprocably movable spring biased plunger means, and a reduced diameter lower end section of said plunger means adapted to extend through a said aperture in said door plate axially aligned with said tubular section for resiliently engaging said sealing means.

3. A coke oven door as in claim 2, wherein a guide plate is secured to said door plate which supports the lower end of said tubular section, and said guide plate having a bore therein in axial alignment with said tubular section and of smaller diameter than the inner diameter of said tubular section adapted to receive slidably therein said reduced diameter lower end of said plunger means.

4. A coke oven door as in claim 2, wherein said passages in said rectangular bar are threaded for retaining therein a threaded adjusting means adapted to adjust pressure on said spring biased plunger means for maintaining said sealing means in sealing engagement with said frame of the coking chamber.

5. A coke oven door as in claim 2, wherein said tubular section has the opposite ends thereof weldably secured to said rectrangular bar and said guide plate.

6. A coke oven door as in claim 2, wherein several of said transverse braces comprise longitudinally spaced angle bars having the opposite ends thereof secured to one of said longitudinal stiffener plates with their longitudinally extending arms secured to said door plate and the upwardly extending arms perpendicular to said door plate.

7. A coke oven door as in claim 6, wherein a plug member having hook bolts extending outwardly therefrom is supported on the inner surface of said door plate by said hook bolts extending through apertures formed in said door plate and matching passages in said longitudinal extending arms of said angle bars.

8. A coke oven door as in claim 1, wherein a plurality of braces extend laterally outwardly toward the periphery of said door plate with each having one end secured to said stiffener plate and having their opposite ends secured to said door plate.

9. A coke oven door as in claim 8, wherein a plurality of said transverse braces are secured to said stiffener plate, a said rectangular bar and said door plate.

10. A coke oven door as in claim 1, wherein a pair of spaced rectangular blocks extend transversely between said stiffener plates and have their opposite ends secured to a contiguous stiffener plates, said blocks having their lower edges secured to said door plate, and each said block adapted to pivotally support a door latch bar.

11. A coke oven door for sealably closing a coking chamber comprising a rectangular steel door plate having spaced longitudinal and transverse steel rectangular stiffener plates each secured to two other said stiffener plates and to said door plate and spaced inwardly from each longitudinal and lateral edge of the door plate with the wider sides of said stiffener plates disposed perpendicular to the outer surface of the door plate, a plurality of steel transverse angle bars interconnecting the longitudinally extending spaced stiffener plates at spaced intervals along the length of the longitudinal stiffener plates, said angle bars and said door plate having means for supporting a refractory element on said door plate, a plurality of steel transverse braces secured to said door plate and having at least one end thereof secured to a said longitudinal stiffener plate, a rectangular bar secured to the outer end of each of the said stiffener plates extending the length thereof and extending laterally outwardly therefrom to about the edge of said door plate in a plane parallel with the plane of the door plate, said rectangular bars having threaded passages therein as spaced intervals along the length thereof, a section of steel tubing and a guide plate having a bore therein fixedly secured between the lower surface of the said steel rectangular bars and the steel door plate with both the tubing and said box in axial alignment with one of said passages in said rectangular bars, and said sections of tubing and guide plates adapted to form spring boxes which coact through apertures in said door plate with a sealing means mountable on the inner surface of said door plate to form a sealing engagement between the said oven door and a door frame of said coking chamber when said oven door is operatively mounted on said coking chamber.

* * * * *

UNITED STATES PATENT AND TRADEMARK OFFICE

CERTIFICATE OF CORRECTION

PATENT NO. : 4,574,035

DATED : March 4, 1986

INVENTOR(S) : Robert W. Highley and Stephen J. Stanczak

It is certified that error appears in the above-identified patent and that said Letters Patent are hereby corrected as shown below:

Column 8, line 24, "box" should read --bore--.

Signed and Sealed this

*Eighth* Day of *July 1986*

[SEAL]

*Attest:*

DONALD J. QUIGG

*Attesting Officer*

*Commissioner of Patents and Trademarks*